US011802361B2

(12) United States Patent
Wang

(10) Patent No.: US 11,802,361 B2
(45) Date of Patent: Oct. 31, 2023

(54) LAUNDRY TREATING APPARATUS WITH VARIABLE LIFTERS

(71) Applicant: Jyhjia Eric Wang, Cypress, CA (US)

(72) Inventor: Jyhjia Eric Wang, Cypress, CA (US)

( * ) Notice: Subject to any disclaimer, the term of this patent is extended or adjusted under 35 U.S.C. 154(b) by 113 days.

(21) Appl. No.: 17/023,920

(22) Filed: Sep. 22, 2020

(65) Prior Publication Data

US 2022/0090308 A1 Mar. 24, 2022

(51) Int. Cl.
*D06F 37/06* (2006.01)

(52) U.S. Cl.
CPC ..... *D06F 37/06* (2013.01)

(58) Field of Classification Search
CPC ..... D06F 37/06
See application file for complete search history.

(56) References Cited

U.S. PATENT DOCUMENTS 2,660,870 A * 12/1953 Kennedy ..... D06F 39/125 248/616
3,938,260 A * 2/1976 Brenner ..... D06F 58/04 366/342
2004/0118168 A1* 6/2004 Woo ..... D06F 37/06 68/207
2015/0007395 A1* 1/2015 Kim ..... D06F 37/065 68/142
2019/0093278 A1* 3/2019 Snook ..... D06F 37/06
2021/0040671 A1* 2/2021 Choi ..... D06F 37/06

FOREIGN PATENT DOCUMENTS

KR 101130480 B1 * 3/2012
KR 2014084951 A * 7/2014

OTHER PUBLICATIONS

Machine translation of KR 101130480B1 to Bang. (Year: 2012).*
Machine translation of KR 1020140084951A to Hong. (Year: 2014).*

* cited by examiner

*Primary Examiner* — Joseph L. Perrin

(57) ABSTRACT

A laundry treating apparatus having a horizontally rotatable drum with a plurality of variable lifter blades protruding from the drum inner cylindrical surface toward drum inner space and in parallel to the axis of drum rotation. The variable lifter blade is rotatably mounted on a hinge rod which is attached to the drum inner cylindrical wall such that the lifter blade is predisposed to tilt to a variable angle in relation to the drum circumference by different directions and speeds of drum rotation and influence from the laundry mass.

10 Claims, 6 Drawing Sheets

FIG. 4
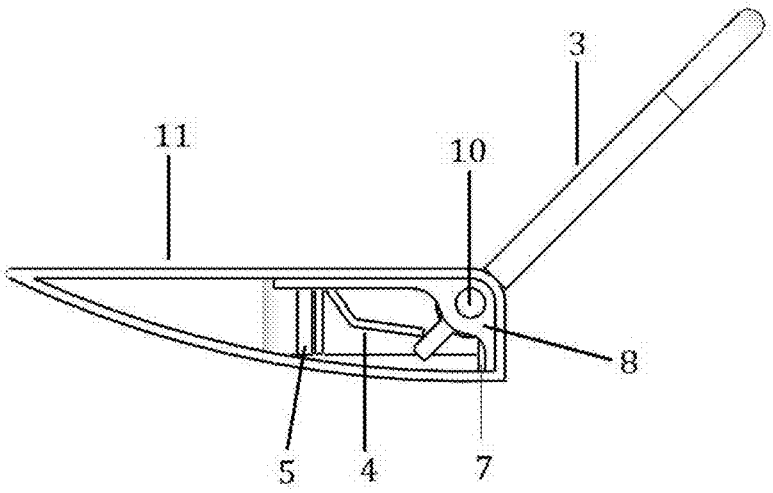
FIG. 5
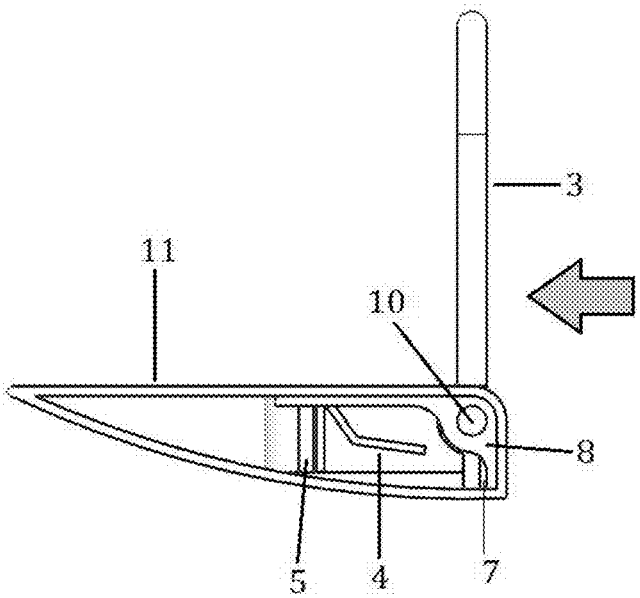
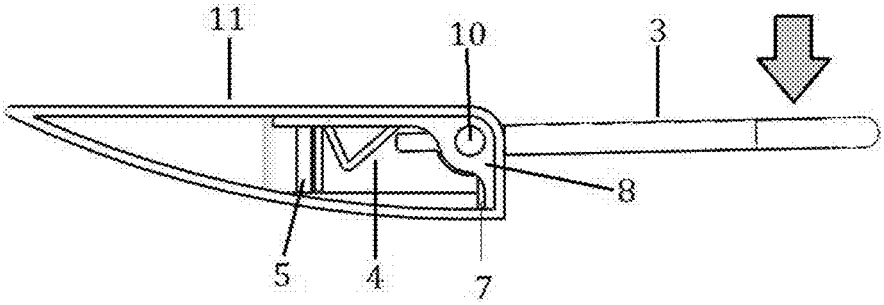
FIG. 6

LAUNDRY TREATING APPARATUS WITH VARIABLE LIFTERS

CROSS-REFERENCES TO RELATED APPLICATIONS

Not Applicable.

STATEMENT REGARDING FEDERALLY SPONSORED RESEARCH OR DEVELOPMENT

Not Applicable.

THE NAMES OF THE PARTIES TOA JOINT RESEARCH AGREEMENT

Not Applicable.

INCORPORATION-BY-REFERENCE OF MATERIAL SUBMITTED ON A COMPACT DISC

Not Applicable.

BACKGROUND OF THE INVENTION

1. Technical Field

This invention is a laundry treating apparatus to be used in horizontal laundry washers and dryers wherein a plurality of variable lifters disposed on the cylindrical wall of a horizontal drum automatically alter their posture in response to different directions and speeds at which the horizontal drum rotates to facilitate washing, dewatering, and drying activities.

2. Background Art

In laundry washers employing a cylindrical drum rotating around a horizontal axis, the lifters disposed on the drum inner cylindrical wall are expected to perform at least three functions: (1) to flip and turn the laundry to ensure thorough wetting; (2) to lift laundry up and drop from apex of rotation path to make the laundered items rub against each other; and (3) to rinse the laundry by pushing it through a pool of washing fluid. Many prior arts have posited the importance of wetting, rubbing, and striking the laundry to promote washing efficacy. Prominent lifters with big surface area will understandably perform these functions more effectively than low and short lifters.

Lifters firmly fixed to the drum cylindrical wall tend to hinder movement of the laundry along the drum circumference causing pilings to generate excessive vibration during high-speed drum spin for dewatering the laundry by centrifugal force. To mitigate this undesirable consequence, most conventional lifters are short and low, trading off aforementioned functionality to some extent. Some prior arts disclosed designs such as textured or ribbed drum inner circumferential surface to produce traction intended to compensate for compromised lifter functionality. One prior art describes a washer with complex drum motions to produce 3-dimensional laundry movements to achieve striking and rubbing effects without lifters.

Laundry tumble-dryers employ horizontal drum to utilize the gravity of the laundry. Horizontal dryer drums invariably comprise a plurality of prominently protruding lifters to lift the laundry up and drop from apex of rotation path and to spread open damp laundry to aid moisture evaporation and smooth out wrinkles. But prominently protruding lifters are not utilized in washer-dryer combination machines partly due to concerns of aforementioned vibration caused by prominent lifters. Consequently, drying efficiency in washer-dryer combination machines without prominent lifters is compromised, resulting in long drying time and wrinkles on dried clothes.

There is an obvious usefulness in a prominent lifter that can push laundry up to drop from apex of rotation path to achieve striking and rubbing, collapse to avoid hindering circumferential movement of laundry in high-speed drum spin dewatering, and rise again to lift and toss the laundry to promote tumble-drying efficiency. Such a lifter will be especially useful for washer-dryer combination machines.

BRIEF SUMMARY OF THE INVENTION

This invention is a laundry treating apparatus where in a plurality of variable lifters rotatably hinged on the inner cylindrical surface of a drum rotatable about a horizontal axis. When the drum rotates in a first direction, the lifter pushes the laundry up to drop from the apex of rotation path. When the drum rotates in a second direction, which is the reverse of the first direction, the lifter yields to the weight of overlaying laundry articles, and further collapses to the drum cylindrical wall when drum spins in high-speed for centrifugal dewatering. The lifter is erected again to toss around dewatered laundry for tumble-drying when the drum rotation reverses to first direction.

BRIEF DESCRIPTION OF SEVERAL VIEWS OF THE DRAWINGS

FIG. 4 shows a lifter blade in its free-standing state.

FIG. 5 shows a lifter blade tilted up by force represented by the arrow sign.

FIG. 6 shows a lifter blade collapsed by force represented by the arrow sign.

DETAILED DESCRIPTION OF THE INVENTION

This laundry treating apparatus disclosed herein may be used in laundry washer, laundry dryer or laundry washer-dryer combination machines.

This laundry treating apparatus comprise: a tub that holds liquid defining a liquid chamber; a perforated cylindrical drum rotatable about a horizontal axis mounted inside the liquid chamber with which the drum communicates fluidly partially defining a treating chamber, an open end defining access to this treating chamber, and a plurality of variable lifters secured on the inner cylindrical surface of the drum.

A variable lifter comprises a lifter blade and a lifter base.

A lifter base comprises a shell, a cylindrical hinge rod, a lifter spring and a bracket to secure the lifter spring on the hinge rod, and two rod supports to secure the hinge rod to the shell.

Figure 1:
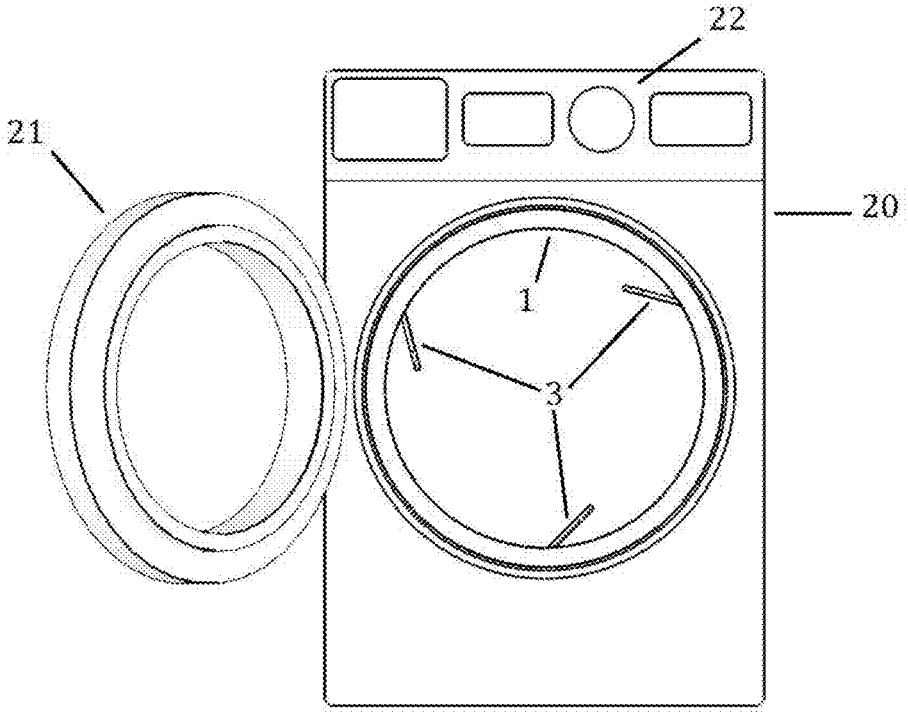
FIG. 1 is a simplified frontal view from the drum open end of a washer-dryer combination machine as an example for the illustration of this disclosure.

FIG. 1 is a simplified frontal view of a washer or dryer or a washer-dryer combination machine with an outer cabin 20, a hinged door 21 to complete closure of the treating chamber, and control panel 22, as an illustrative example to show lifter blades 3 in their free-standing state inside an empty cylindrical drum 1.

Figure 2:
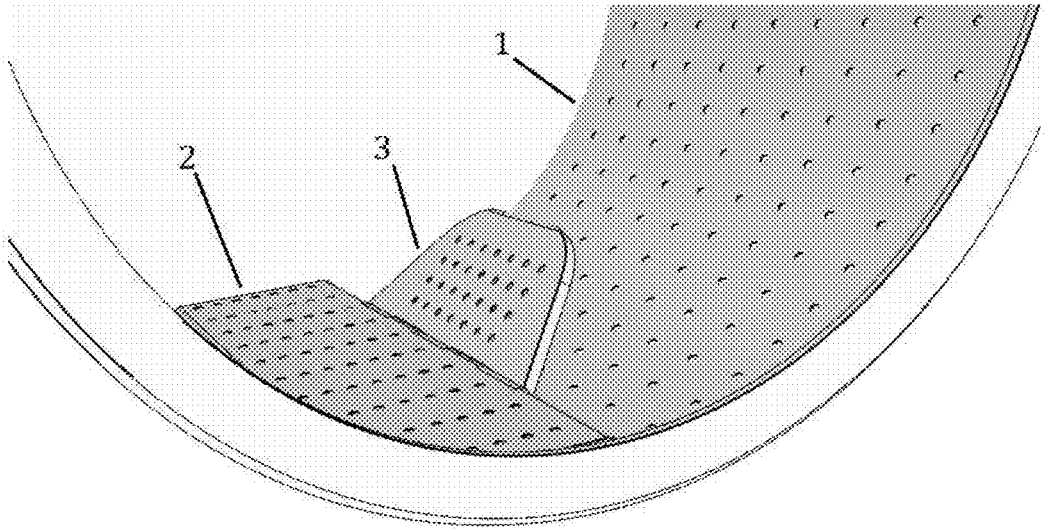
FIG. 2 is a perspective view of a lifter blade and a lifter base in a drum.

FIG. 2 is an isometric view of a lifter blade 3 and lifter base 2 secured on the inner cylindrical surface of a cylindrical drum 1.

Figure 3:
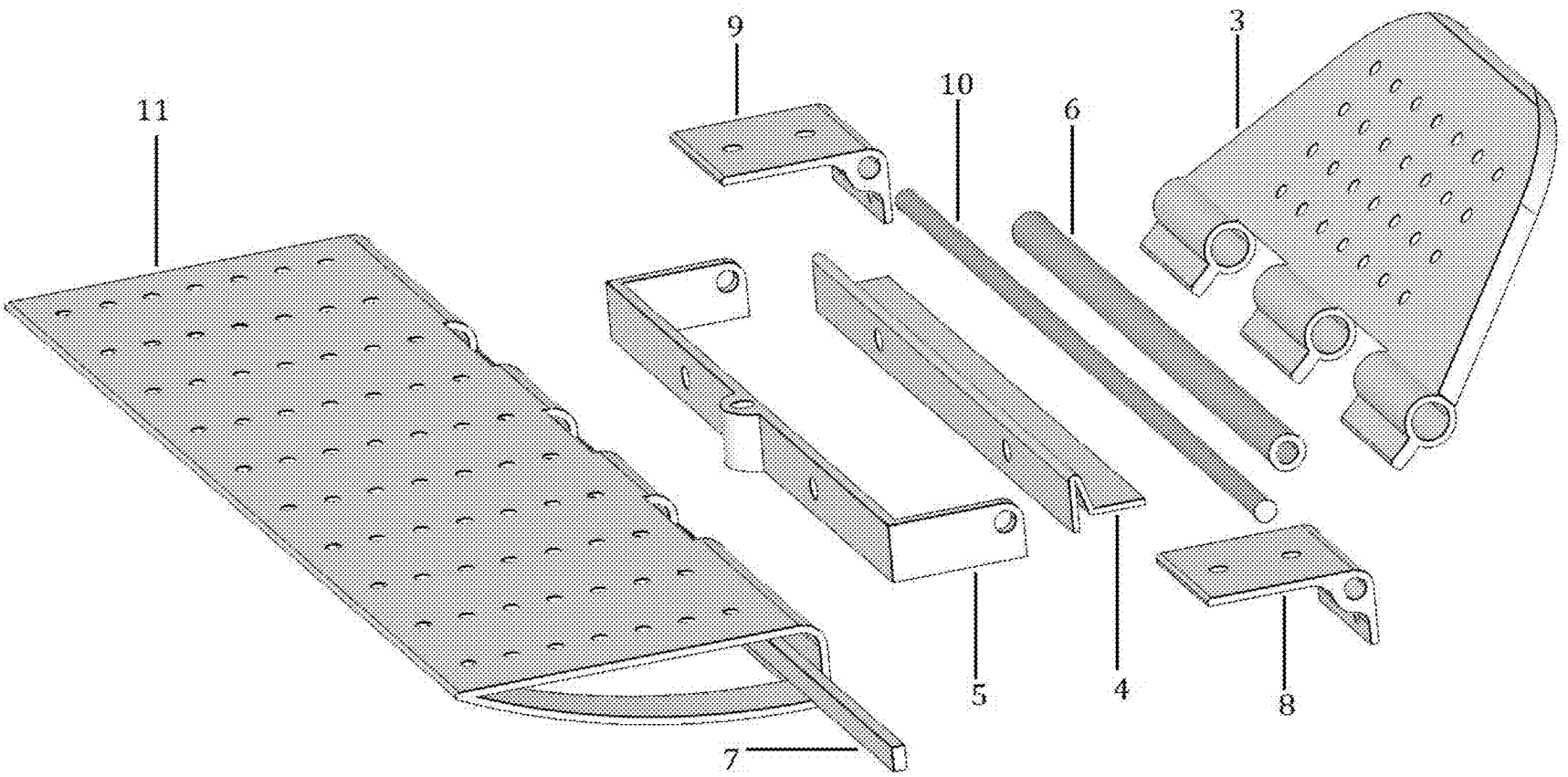
FIG. 3 is an exploded view of the components.

FIG. 3 is an exploded view of the components showing: lifter blade 3; lifter spring 4; spring bracket 5; Teflon sleeve 6; lifter blade limiter 7; hinge rod supports 8 and 9; hinge rod 10, and base shell 11.

The lifter blade limiter 7 in FIG. 3 is actually inside base shell 11, abutting center section of the vertical wall of base shell 11 to underlie all the lower tips of the lifter blade 3, but is slid out partially in this view to show its presence.

Base shell 11 may be fabricated from sheet metal or extruded metal profile to comprise 3 sides: a flat horizontal side, a flat vertical side perpendicular to both the horizontal side and adjoining drum circumference, and a curved bottom side which conforms to the drum circumference underlying the horizontal side whereto the lifter base is secured.

Base shell 11 further comprises at least one cutouts along the ridge of the base shell where the horizontal side turns into the vertical side.

Lifter blade 3 may be fabricated from sheet metal, extruded metal profile, or molded temperature-resistant hard plastic material with metal inserts.

Lifter blade 3 comprises one hollow cylindrical channel parallel to the drum rotation axis through the portion of the lifter blade body enclosed in the base shell 11 for inserting the hinge rod 10 and Teflon sleeve 6.

Lifter blade 3 further comprises at least one hinge knuckles in the form of cutouts spaced along the hollow cylindrical channel.

Lifter spring 4 is made from high carbon spring steel.

Hinge rod 10 is a cylindrical metal rod or tube to be inserted through Teflon sleeve 6 to eliminate friction between the hinge rod 10 and the hollow cylindrical channel of the lifter blade 3.

Alternatively, the hinge rod 10 and Teflon sleeve 6 may be replaced by one bigger cylindrical rod supported by bearings installed on the two hinge rod supports 8 and 9 to achieve the same friction-free performance.

Hinge rod supports 8 and 9 may be made from die-cast metal or equivalent.

Components in FIG. 3 are assembled by first inserting the knuckles on the hollow cylindrical channel of the lifter blade 3 into the cutouts on base shell 11 followed by inserting the Teflon tube 6 to set their positions in the assembly.

Fasten lifter spring 4 on spring bracket 5 by fasteners through the holes.

Straddle spring bracket 5 over the knuckles of the lifter blade 3 and align the holes of the spring bracket 5 with the Teflon tube 6 to insert the hinge rod 10.

Slide hinge rod mounts 8 and 9 onto the two ends of the hinge rod 10.

Secure hinge rod supports 8 and 9 using fasteners onto the inside surface of base shell 11 to both the horizontal and vertical sides of the base shell 11.

FIG. 4 shows lifter blade 3 leans away from base shell 11 in its default free-standing posture hinged on the base shell 11 by hinge rod 10.

Lifter blade 3 is held in this default posture by the force of lifter spring 4 which is barely adequate to offset the torque of the lifter blade portion above the lifter base, so that the lifter blade 3 yields readily to forces from either side.

FIG. 5 shows the lifter blade 3 tilts up toward base shell 11 when acted upon by force in the direction represented by the arrow sign.

Lifter blade limiter 7 in base shell 11 limits the maximum tilt of the lifter blade 3 to a posture pointing at the axis of drum rotation, and the lifter blade 3 never overlies the horizontal surface of the base shell 11 as shown in FIG. 5.

The lifter spring 4 having no effect on the lifter blade 3 between its default posture and maximum tilt, as can be seen by comparing FIGS. 4 and 5, maximizes the tendency of the lifter blade 3 opening to push laundry when the drum 1 rotates in the direction the lifter blade 3 points, counter-clockwise (CCW) in this illustrative example.

Figure 9:
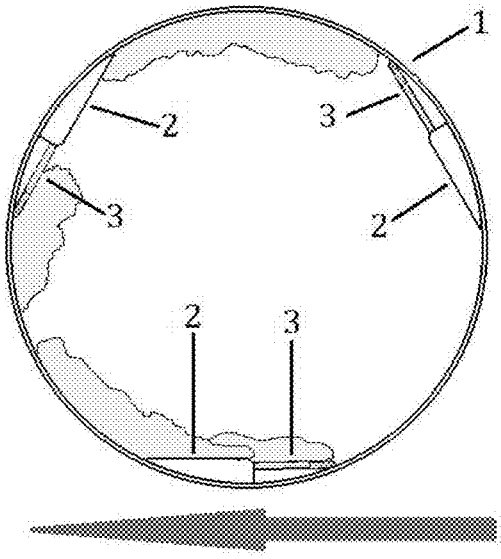

The lifter spring 4 is overpowered easily by the weight of laundry, and by centrifugal force when drum spins clockwise (CW) at higher speed, due to the longer moment arm of the portion of lifter blade outside the base shell 11 than that of the lifter blade portion inside. The result of this lever action is shown in FIGS. 6 and 9.

The lifter spring 4 is secured on spring bracket 5, which is rigidly secured on the hinge rod 10, so that its relative position in relation to the lifter blade 3 is tightly confined and possibility of the lifter blade 3 slipping by lifter spring 4 is prevented.

Water and washing liquids will provide lubrication between the lifter spring 4 and the lifter blade 3 in action.

Laundry is disposed inside the drum for treatment through the open end of the drum, and washer program settings are enacted as is conventionally done.

Water and treating chemicals are charged into the drum at their respective appropriate timing as is conventionally done.

Figure 7:
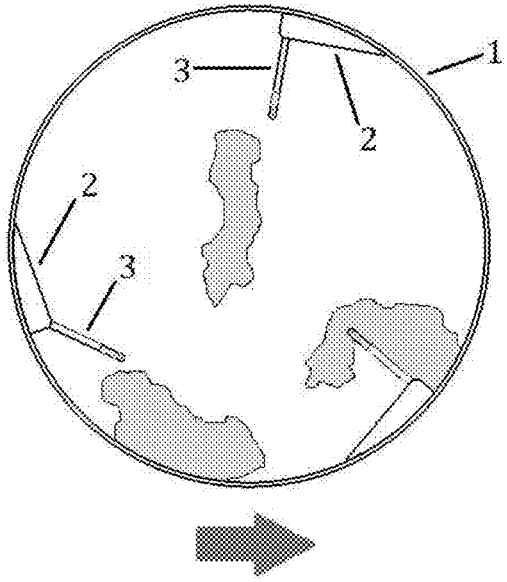
FIGS. 7 through 10 provide visual aids to show lifters reacting to laundry in different drum rotation directions and speeds represented by arrow signs.

For washing the laundry, the drum is driven by the motor to rotate CCW in this example, as shown by the arrow sign in FIG. 7.

The lifter blade 3 pushing against the laundry is held pointing at the axis of drum rotation by the lifter blade stopper 7 shown in FIG. 5 during its CCW rise to push the laundry all the way to the apex of its path to drop the laundry.

After the lifter blade 3 reaches the apex of this CCW rotation and drops its load of laundry, said lifter blade 3 resumes its default posture by the act of stressed lifter spring 4 shown in FIG. 6, such that said lifter blade 3 is ready to push the next portion of the laundry as it descends, as shown in FIG. 7.

The fallen load smacks the nadir of the drum inner circumferential surface or other parts of the laundry to generate friction between laundered items to effectuate washing action.

Figure 8:
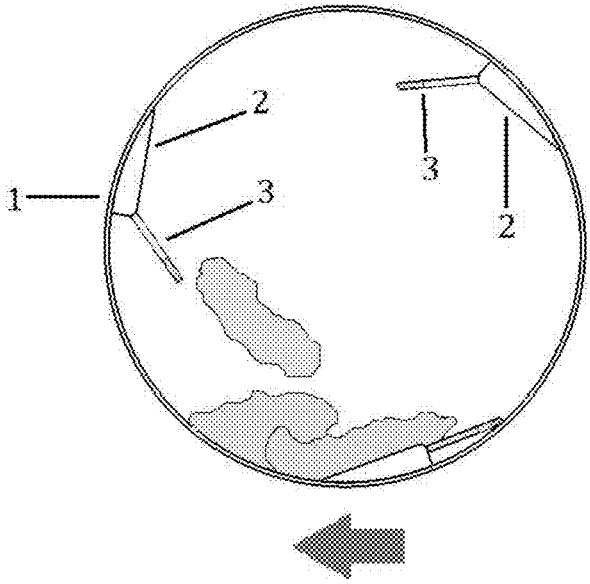

To rinse the laundry, the motor drives the drum 1 to oscillate back and forth so that the lifter blade 3 pushes the laundry through a pool of fluid on the bottom of the drum (not shown) when the drum rotates CCW, and retreats when the motor reverses the drum to rotate CW for the stressed spring 4 shown in FIG. 6 to push and erect the lifter blade 3 to be ready for the next push when the motor switches the drum to rotate CCW again. This oscillating action can be perceived by FIGS. 7 and 8.

An alternative way to rinse the laundry is having the motor drive drum 1 to rotate CCW continuously at low speed to force the laundry through the fluid (not shown) repetitively, with CW rotations interspersed to flip the laundry.

After washing and rinsing, the drum 1 is switched to rotate CW slowly with surges initially to jolt any laundry items caught under the lifter blades 3 out to the open and fall on top of the other lifter blades or areas between lifter bases 2 while the drum speed increases.

When the motor increases drum speed gradually in this CW rotation, the lifter blades 3 gradually tilt down toward the drum circumference.

The laundry items will encounter less resistance in sliding and rolling along the circumference as the centrifugal force increases with drum speed, and eventually all lifter blades are forced to collapse on the drum cylindrical wall as FIG. 9 shows.

Transition from drum cylindrical wall to adjoining the flat horizontal side of the base shell 11 is a subtle and gradual change of elevation to the laundry items when the drum rotates CW, allowing the laundry to roll or slide over without as much hindrance as it would encounter with a precipitous barrier such as a fixed lifter.

This CW drum rotation continues increasing speed until sufficient centrifugal force is generated to push the laundry and all the lifter blades onto the inner cylindrical wall of the drum, and centrifugal dewatering can proceed in even higher speed drum spin, as shown in FIG. 9.

Since the lifter blades all collapse out of the way when the drum turns CW in high speed, there is no hindrance against the movement of the laundry, and occurrence of mass pilings due to precipitous barriers can be avoided.

Figure 10:
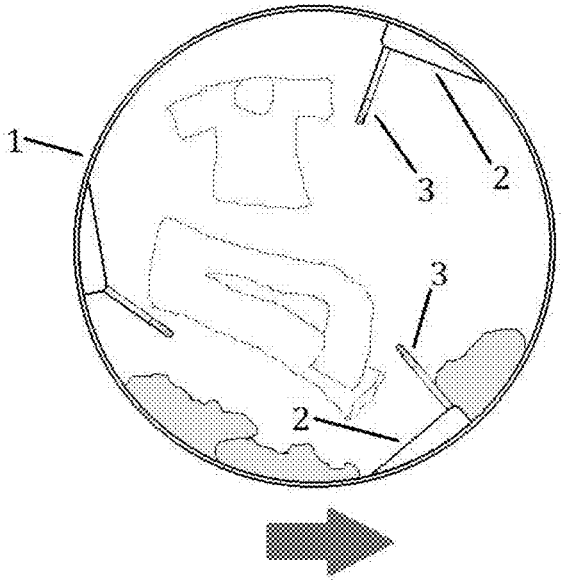

After the laundry is dewatered, the motor switches back to rotate the drum CCW for tumble-drying the laundry. FIG. 10 shows how the lifter blades 3 can toss the laundry in air like fixed protruding lifters in a conventional tumble-dryer do.

It should be understood that the shape, size and number of the lifter blades may vary to suit different drum sizes, types of laundry, and other aspects of machine design as long as the merit of the lifter blades automatically adjusting their orientation in action is preserved.

Figure 11:
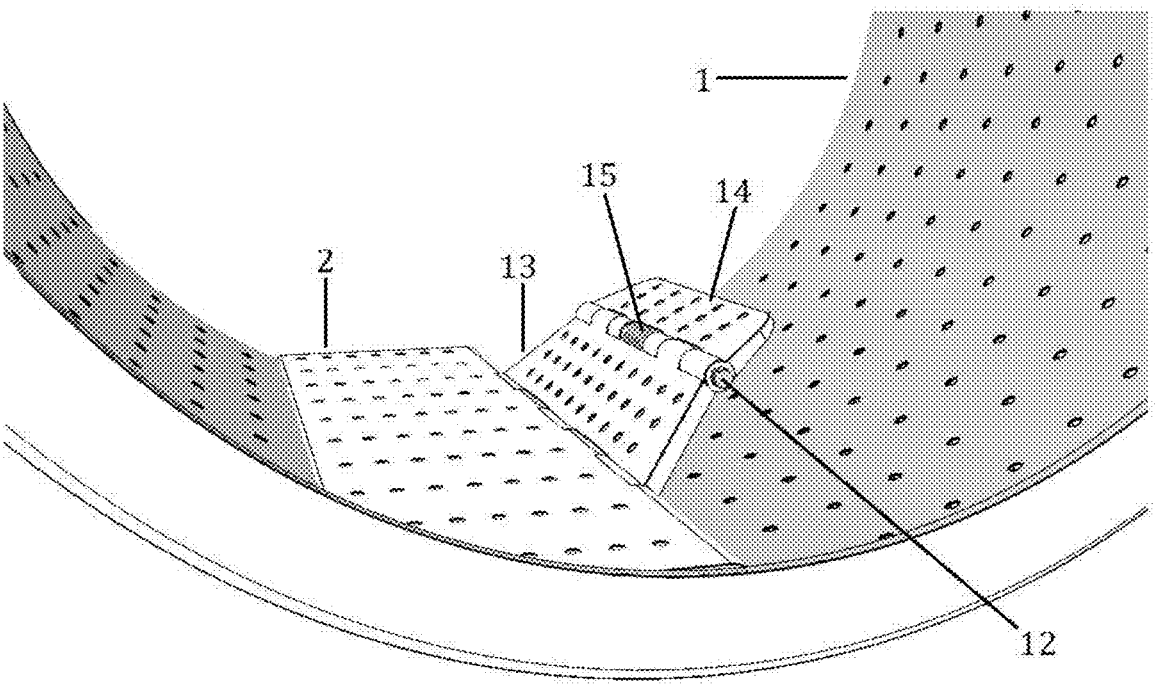
FIG. 11 is perspective view of an alternative two-section lifter blade.

As one alternative design, the portion of the lifter blade outside the lifter base comprises a lower section 13 and an upper section 14 to form a hinge joined by a hinge pin 12 and a torsion spring 15, as shown in FIG. 11, such that the upper section of the lifter blade 14 is predisposed to further adjust to external forces from the laundry mass.

Figure 12:
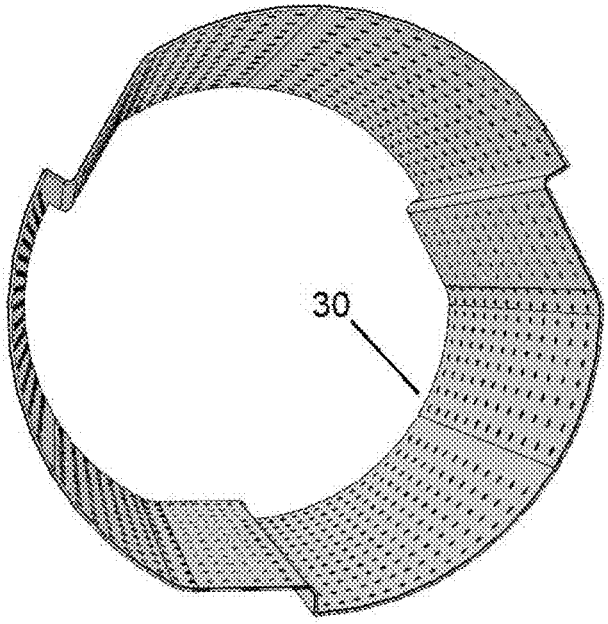
FIG. 12 is perspective view of a drum in an alternative embodiment of this invention.
Figure 13:
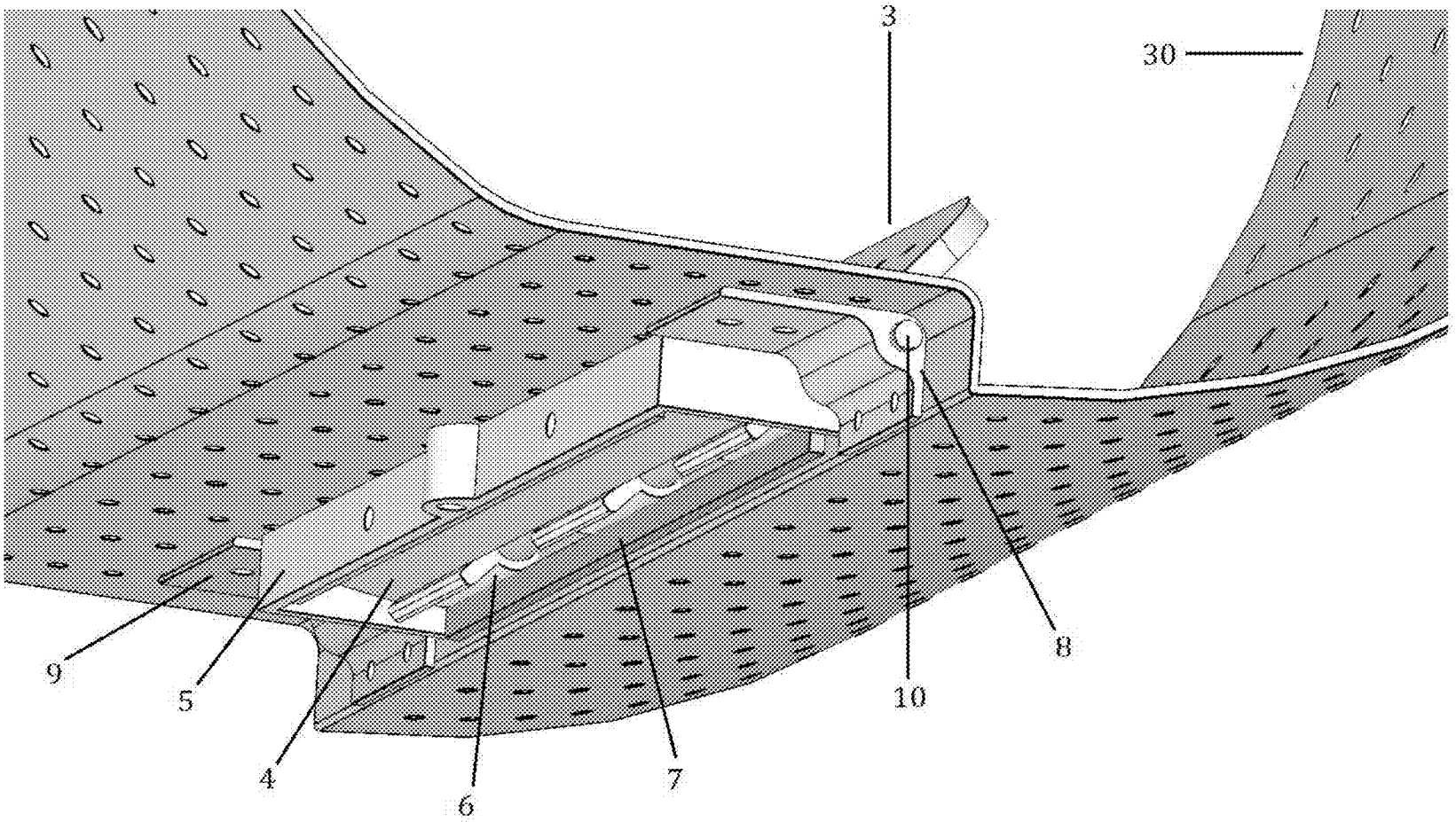
FIG. 13 is perspective view of an assembled alternative embodiment of this invention.

In a second embodiment, the drum and the base shell may be integrated into one unitized body 30, as shown in FIG. 12, utilizing the same set of components shown in FIG. 3 assembled in the same way outside the drum, as shown in FIG. 13, to achieve the same results.

It should be obvious that the inclination direction of the lifter blade and its position relative to its base can be reversed to achieve the same results simply by reversing directions of the drum rotation for respective tasks heretofore. Such reversal of direction should be considered as identical to this invention.

The invention claimed is:

1. A laundry treating apparatus comprising:

a tub that holds liquid defining a liquid chamber;

a perforated cylindrical drum rotatable about a horizontal axis mounted inside the liquid chamber wherein the perforated cylindrical drum has a closed rear end and an open front end allowing access to the inside of this treating apparatus;

a plurality of lifter bases disposed on an inside surface of a drum cylindrical wall between the open and closed ends of the perforated cylindrical drum;

a cylindrical hinge rod parallel to the axis of drum rotation disposed inside each said lifter base between the open and closed ends of the perforated cylindrical drum;

a perforated lifter blade, comprising at least one section, with bottom hinged to each of said lifter base by said cylindrical hinge rod and restricted to rotate about said cylindrical hinge rod within an angular range of 0 to 90 degrees with respect to the drum cylindrical wall;

a spring mechanism with sufficient force to erect each lifter blade to a predetermined angle smaller than 90 degrees with respect to the drum cylindrical wall and leaning away from its lifter base when said lifter blade is not under the influence of any other external forces while said perforated cylindrical drum rotates in a first direction, and while said perforated cylindrical drum rotates in a second direction opposite to said first direction to allow said lifter blade to yield to the weight of any object falling on said lifter blade, the torque from drum rotation, or the combination of the two, pushing said lifter blade toward the drum cylindrical wall; and a limiter fixed to each blade base to restrict the maximum lifter blade swing to standing perpendicular to the drum cylindrical wall such that said lifter blade can never overlie its lifter base in order for said lifter blade to deliver a firm upward push while the drum rotates in said first direction.

2. The laundry treating apparatus of claim 1 wherein each of the plurality of lifter bases comprises one ridge parallel to the axis of drum rotation.

3. The laundry treating apparatus of claim 2 wherein the lifter base further comprises at least one cutout along the ridge of the lifter base to serve as hinge knuckles.

4. The laundry treating apparatus of claim 1 wherein each of the plurality of lifter blades comprises a hollow cylindrical channel parallel to the drum rotation axis through the portion of a lifter blade body in alignment with the lifter base ridge for inserting the cylindrical hinge rod.

5. The laundry treating apparatus of claim 4 wherein the lifter blade further comprises at least one hinge knuckle in the form of at least one cutout spaced along a hollow cylindrical channel to mesh with the at least one knuckle on the lifter base to form a hinge joined by the cylindrical hinge rod.

6. The laundry treating apparatus of claim 1 wherein the spring mechanism may be a flat spring fastened to a spring bracket secured on the cylindrical hinge rod pressing down the end portion of said lifter blade inside the lifter base, or a torsion spring on said cylindrical hinge rod, or both types of springs used in combination.

7. The laundry treating apparatus of claim 1 wherein the smaller than 90 degree angle while the perforated cylindrical drum rotates in a first direction is a force equilibrium between the spring mechanism, which holds down a lower portion of each of the plurality of lifter blades inside the lifter base, and the weight of the upper portion of the lifter blade outside the lifter base, so that said lifter blade protrudes toward a drum inner space and leans away from its lifter base when said lifter blade is not under the influence of any other forces and stands erected to receive and push against front side oncoming objects, and allowing said lifter blade to collapse under the weight of objects falling on its back side while the perforated cylindrical drum rotates in a second direction opposite the first direction.

8. The laundry treating apparatus of claim 7 wherein the lifter blade is further limited by the limiter in its upward tilt to the position wherein the lifter blade points at the axis of the drum rotation, so that the lifter portion outside the lifter base never overlies the horizontal surface of said lifter base when the perforated cylindrical drum rotates in the first direction.

9. The laundry treating apparatus of claim 1 wherein adjacent portions of the lifter blade outside the lifter base are joined by a hinge pin and a torsion spring such that an upper section of the lifter blade is predisposed to further yield to external forces.

10. The laundry treating apparatus of claim 1 wherein a drum spin of first and second directions mean if one is clockwise, the other one is counterclockwise and vice versa.

* * * * *